US005985776A

United States Patent [19]

Bertrand et al.

[11] Patent Number: 5,985,776

[45] **Date of Patent: *Nov. 16, 1999**

[54] NONWOVEN BASED ON POLYMERS DERIVED FROM LACTIC ACID, PROCESS FOR MANUFACTURE AND USE OF SUCH A NONWOVEN

[75] Inventors: Eric Bertrand, Muntzenheim; Philippe Guipouy, Guebwiller; Patrick Lauffenburger, Vogelgrun; Philippe Ehret, Fortschwihr, all of France

[73] Assignee: Fiberweb France, Biesheim, France

[ * ] Notice: This patent issued on a continued prosecution application filed under 37 CFR 1.53(d), and is subject to the twenty year patent term provisions of 35 U.S.C. 154(a)(2).

[21] Appl. No.: 08/284,001

[22] Filed: Aug. 1, 1994

[30] Foreign Application Priority Data

Aug. 2, 1993 [FR] France ..... 93 09649

[51] Int. Cl.[6] ..... C08G 63/08

[52] U.S. Cl. ..... 442/400; 442/401; 442/414; 428/913; 525/415

[58] Field of Search ..... 428/913, 219, 428/220, 224, 227, 229, 286, 245, 280, 288, 289, 338, 339; 442/327, 414, 400, 401; 525/415

[56] References Cited

U.S. PATENT DOCUMENTS

| | | | |
|---|---|---|---|
| 4,045,418 | 8/1977 | Sinclair | 528/357 |
| 4,057,537 | 11/1977 | Sinclair | 528/354 |
| 4,073,852 | 2/1978 | Mesek | 428/264 |
| 4,910,064 | 3/1990 | Sabee | 428/293 |
| 4,997,446 | 3/1991 | Thoma . | |
| 5,010,145 | 4/1991 | Ikada et al. . | |
| 5,206,341 | 4/1993 | Ibay et al. . | |
| 5,294,469 | 3/1994 | Suzuki et al. | 428/913 |
| 5,300,358 | 4/1994 | Evers | 428/913 |
| 5,437,918 | 8/1995 | Taniguchi et al. | 428/480 |

*Primary Examiner*—Elizabeth M. Cole
*Attorney, Agent, or Firm*—Weiser and Asociates, P.C.

[57] ABSTRACT

A nonwoven fabric formed from filaments made from a polymer derived from L- and D-lactic acid. The nonwoven fabric is biodegradable and especially suitable for use in disposable hygiene products.

17 Claims, 4 Drawing Sheets

NONWOVEN BASED ON POLYMERS DERIVED FROM LACTIC ACID, PROCESS FOR MANUFACTURE AND USE OF SUCH A NONWOVEN

The present invention relates to the field of nonwovens, especially at least partially degradable nonwovens, and its subject is a completely degradable nonwoven which can be assimilated by the environment, a process for its manufacture and its various uses.

At present most of the nonwovens produced are made based on synthetic polymers such as polypropylene, polyethylene, polyesters or polyamides, which are practically nondegradable, especially nonbiodegradable, this being all the more so since they frequently incorporate stabilizers or other additives which extend their lifetime.

With a view to attempting to overcome this disadvantage, it has been proposed to include photosensitive agents in the composition of the filaments of nonwovens in order to start a photooxidation reaction.

It has also been proposed to produce nonwovens from thermoplastic polymers derived from starch or based on polycaprolactones or on polyhydroxybutyrates/polyhydroxyvalerates.

However, the nonwoven products obtained do not exhibit sufficiently satisfactory properties (mechanical strengths, physicochemical properties) allowing them to be applied and, furthermore, their cost of manufacture is too high in comparison with synthetic polymers.

In addition, the filaments obtained using these materials always have high deniers, rarely lower than 10 dtex, as a result of the nature and of the characteristics of the materials employed.

The problem posed in the present invention consists, therefore, in conceiving a nonwoven which is entirely biodegradable, compostable and capable of being assimilated by the environment, in which the filaments have a very low denier and the costs of manufacture of which are low and the mechanical and physicochemical properties are substantially equivalent to those of synthetic polymers.

To this end a subject of the present invention is a nonwoven consisting of filaments made of a polymeric material, characterized in that all the filaments of which it is composed are made entirely of a polymer or of a mixture of polymers derived from lactic acid.

Another subject of the invention is a process for the production of a nonwoven such as mentioned above, characterized in that it consists essentially in introducing a solid mass of polymers or of a mixture of polymers derived from lactic acid into a heated extruder, in heating the said mass controllably while working it in order to obtain a homogeneous melt exhibiting a determined viscosity, in next conveying the said melt to a die device for forming filaments, in cooling and drawing the filaments thus obtained, in depositing the said filaments, without preferential orientation, on a travelling collecting belt, so as to form a sheet or a nonwoven web and, finally, where appropriate, in integrally bonding the said filaments of the said sheet or of the said web to each other at at least a proportion of their points of intersection and/or in treating the said filaments of the said sheet by immersion, coating, impregnation or spraying.

The invention will be understood better by virtue of the description which follows, which relates to preferred embodiments given by way of examples without any limitation being implied, and explained with reference to the attached diagrammatic drawings, in which.

In accordance with the latter, all the filaments of which the nonwoven is composed are made entirely (as 100% of their composition) of a polymer or of a mixture of polymers derived from lactic acid.

According to a first characteristic of the invention the said polymer(s) of which the said filaments consist is (are) derived from L lactic acid or from D lactic acid or from a mixture of L and D lactic acids.

The said polymer or the said mixture of polymers derived from lactic acid advantageously has a molecular mass of between 100,000 g/mol and 200,000 g/mol and a polydispersity value of between approximately 1 and approximately 3.

In addition, the said polymer(s) derived from lactic acid have a glass transition temperature of between 45° C. and 55° C. and a melting temperature of between 165° C. and 180° C.

By way of example, a polymer A which may be used for the production of a nonwoven in accordance with the invention can be obtained by reacting, in a reactor, lactic acid with a catalyst in the form of stannous octoate mixed with the said lactic acid in a ratio of 0.11% by weight.

The above polymer, which is at a temperature of 209° C. when it leaves the reactor, has a weight-average molecular mass of 132,000 g/mol, a polydispersity value of 1.9, a glass transition temperature of 51.5° C. and a melting temperature of 170.3° C.

With the operating conditions indicated above it is also possible to obtain a polymer B derived from lactic acid and capable of being employed for the production of a nonwoven in accordance with the invention, the said polymer B having a weight-average molecular mass of 158,000 g/mol, a polydispersity value of 2.1, a glass transition temperature of 49° C. and a melting temperature of 171.6° C.

Figure 4:
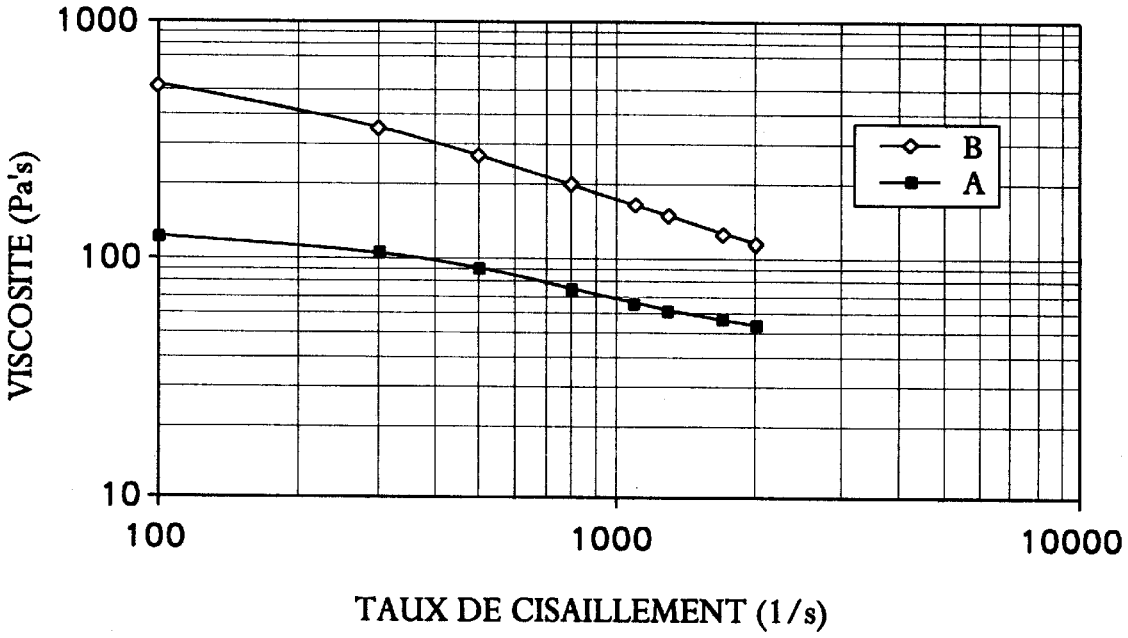
FIGS. 4 and 5 illustrate curves showing, respectively, the change in the viscosity and in the shear stress as a function of the shear rate for two polymers derived from lactic acid and employed for producing a nonwoven according to the invention.
Figure 5:
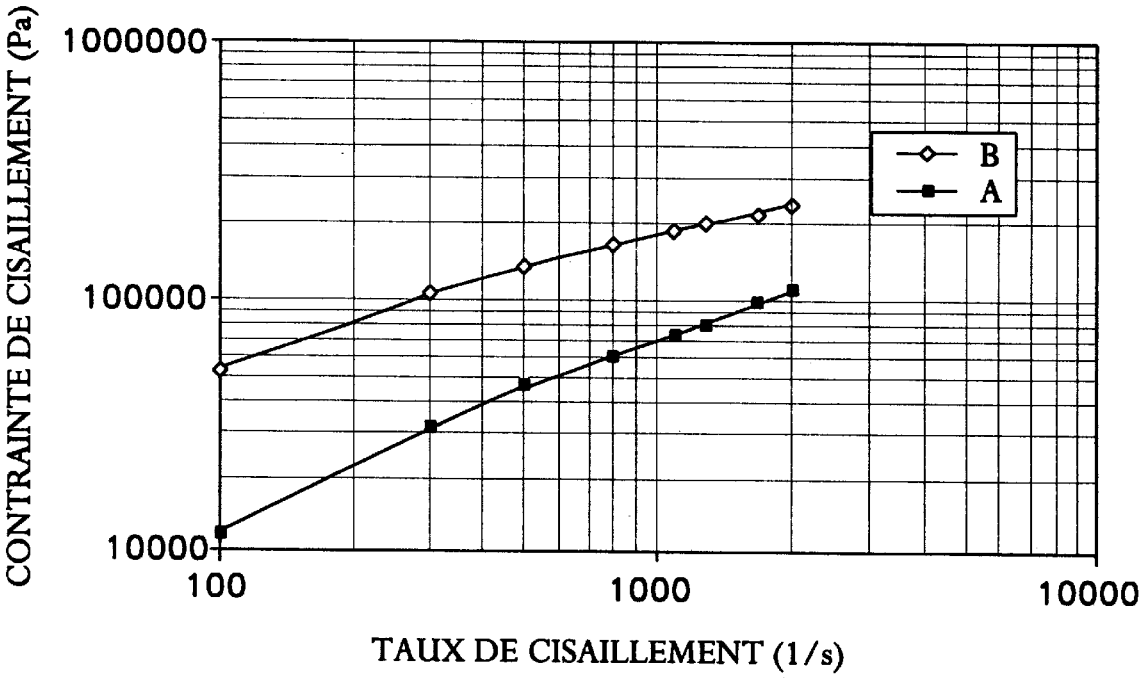

Some other characteristics of the polymers A and B will appear to a person skilled in the art on viewing FIGS. 4 and 5 of the attached drawings.

The abovementioned polymers A and B, and other polymers derived from lactic acid and capable of being used as base material for the production of nonwovens in accordance with the invention, are described in greater detail, with regard to their preparation and their characteristics, in Finnish Patent Application No. 923,167, filed on Jul. 9, 1992 by the company Nesté Oy.

In accordance with another characteristic of the invention, the denier of the filaments of which the nonwoven consists is between 0.5 and 10 dtex, advantageously between 1 and 5 dtex and preferably between 2.5 and 4.5 dtex, it being furthermore possible for the said nonwoven to comprise welds of different geometries between filaments over approximately 5% to 50% of its surface, obtained by hot calendering, preferably over 12%, 24% or 48%, with a view to improving the mechanical behaviour and the strength of the web or of the nowoven sheet.

Moreover, the filaments of which the nonwoven according to the invention consists may also be treated with a view to acquiring special physicochemical properties and, for example, to exhibiting hydrophilic or hydrophobic properties obtained by impregnation or spraying with surface-active agents.

The nonwoven according to the invention, as described above, may be advantageously employed as a partial component or as a sole component of a disposable article, especially for single use, and more particularly, following a special treatment, as a hydrophilic component, especially a surface web, of a disposable hygiene product, for example of a diaper or of a sanitary towel for single use or as a hydrophobic component, especially a barrier surface, of a disposable hygiene product, for example of a diaper or of a sanitary towel for single use, this being done by producing a nonwoven based on the abovementioned polymer A.

With the aid of the abovementioned polymer B it will be possible to produce a nonwoven that can be used as mulching or a protective web for crops.

Figure 1:
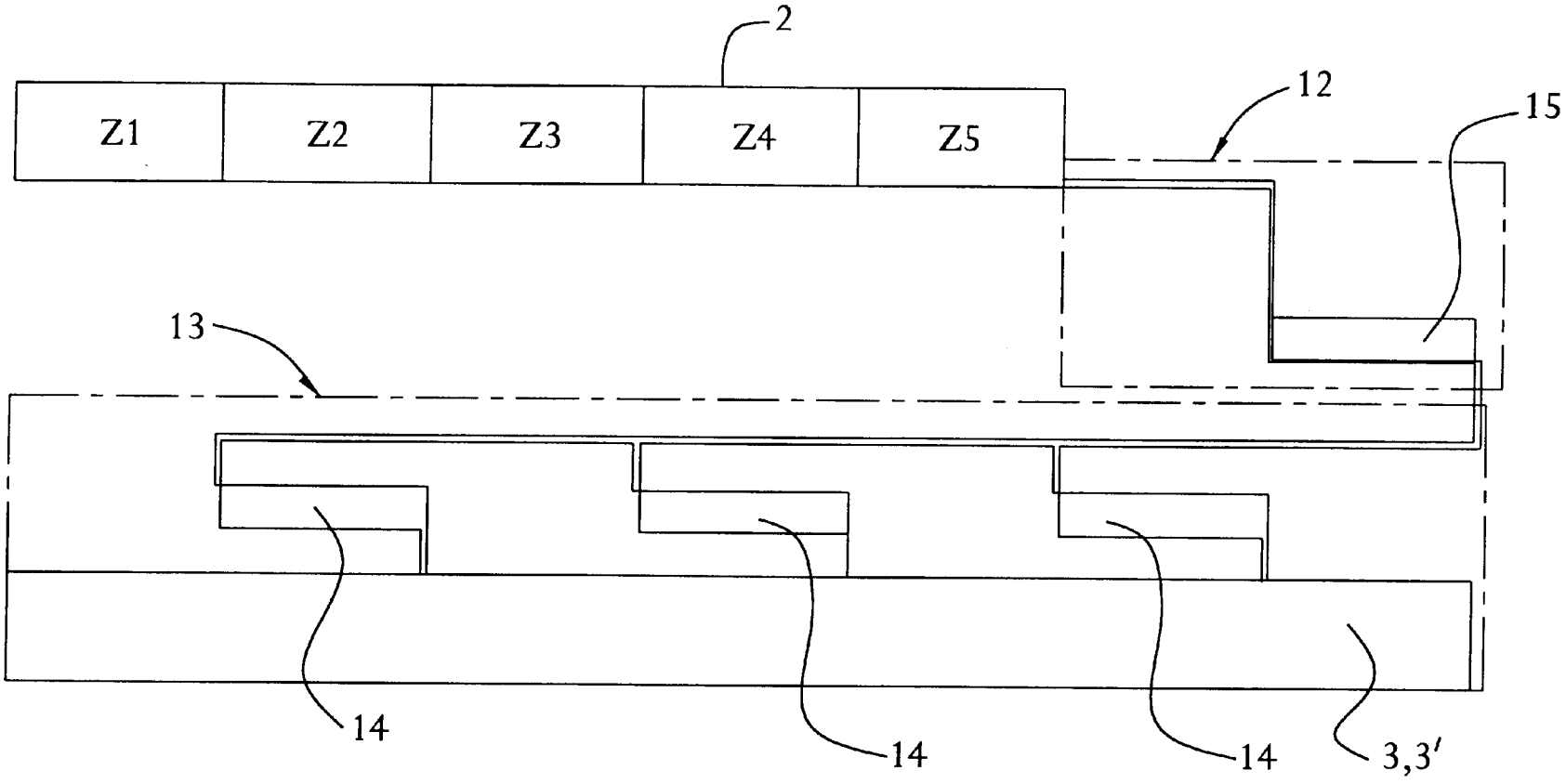
FIG. 1 illustrates diagrammatically an extruder-die unit for implementing the process in accordance with the invention.
Figure 2:
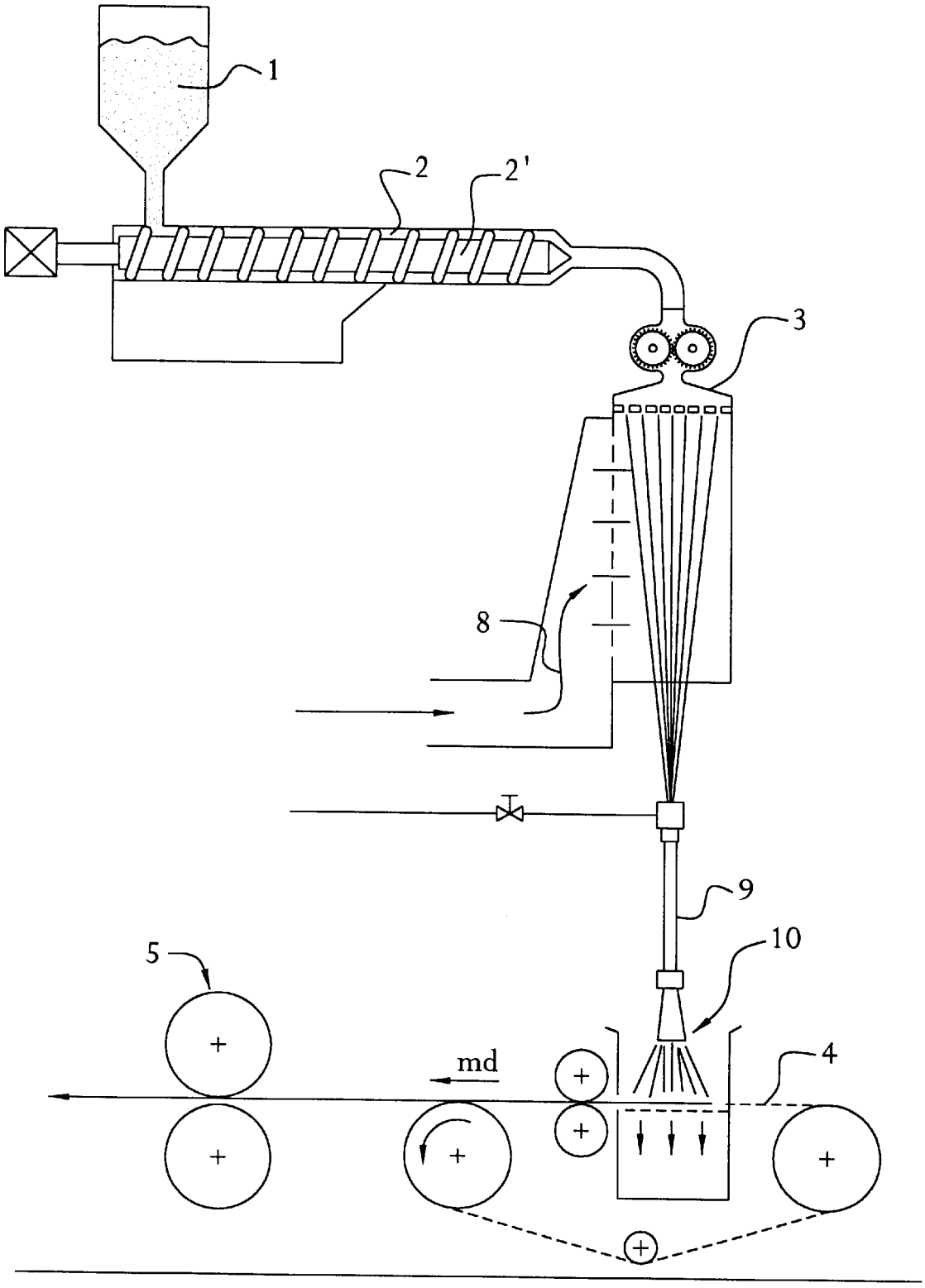
FIG. 2 illustrates a device for implementing the process according to a first embodiment of the invention.
Figure 3:
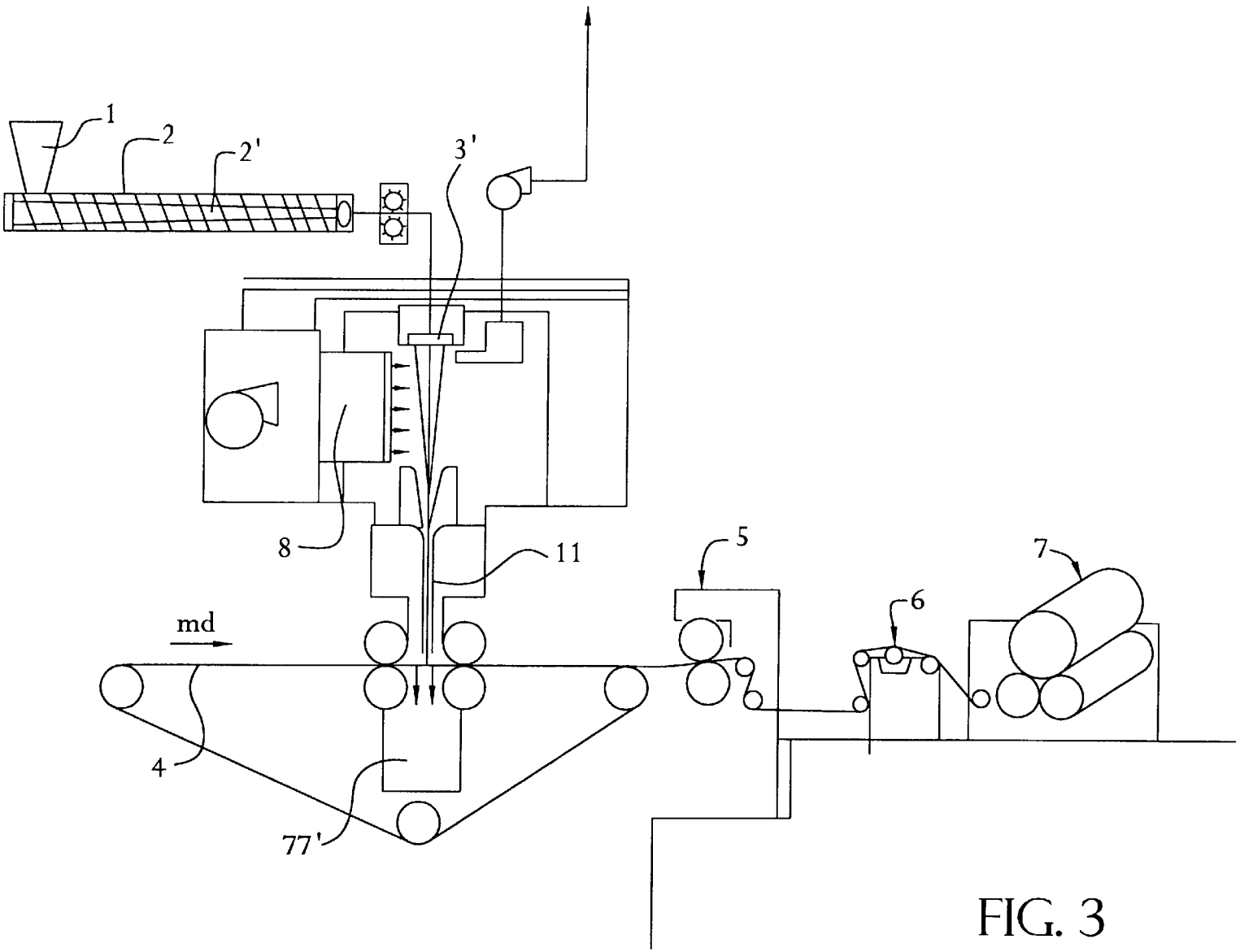
FIG. 3 illustrates a device for implementing the process according to a second embodiment of the invention.

As shown by FIGS. 1, 2 and 3 of the attached drawings, another subject of the invention is a process for producing a nonwoven as described above, the said process consisting essentially in introducing, for example from a storage vessel and in granular or powdery form, a solid mass of polymers or of a mixture of polymers derived from lactic acid into a heated extruder 2, in heating the said mass controllably while working it, in order to obtain a homogeneous melt exhibiting a determined viscosity, in next conveying the said melt to a die device 3, 3' for forming filaments, in cooling and drawing the filaments thus obtained, in depositing the said filaments, without preferential orientation, on a travelling collecting belt 4, so as to form a sheet or a nonwoven web and, finally, where appropriate, in bonding the said filaments of the said sheet to each other at at least a proportion of their points of intersection and/or in treating the said filaments of the said sheet by immersion, coating, impregnation or spraying, this being by means, where appropriate, of a calendering station 5 and/or of a corresponding treatment station 6 through which the web or nonwoven sheet may pass after its formation.

Of course, the web or the nonwoven sheet is finally trimmed to width and reeled at a suitable reeling station 7.

The extruder 2 used advantageously has a single screw 2' (see FIGS. 2 and 3) and its body is surrounded by a plurality of ring heaters defining, in the said body, heating zones Z1 to Z5 (see FIG. 1) which may exhibit increasing values of temperature between the feed entry of the extruder 2, connected to the storage vessel 1, and the exit of the said extruder 2.

According to a first alternative embodiment of the invention, as shown in FIG. 2 of the attached drawings, the process consists in pushing the melt originating from the extruder 2 through a die 3 made up of a number of lands, advantageously seven, and in then cooling the filaments originating from each land with a flow of air 8, in next drawing the said filaments, by Venturi effect, in nozzles 9 and, finally, in depositing the drawn filaments on a travelling collecting belt 4, without preferential orientation and homogeneously, by means of separators 10.

Such a process is more generally known under the name Lurgi in the production of conventional nonwovens.

In accordance with the invention, the extruder 2 is preferably kept at a temperature of between 185° C. and 204° C., giving the mass of polymer(s) derived from lactic acid a determined viscosity allowing it to be handled and conveyed without, however, adversely altering its constituent(s).

According to a second alternative embodiment of the invention, and as shown in FIG. 3 of the attached drawings, the process may also consist in pushing the melt originating from the extruder 2 through a single-block die 3', in then cooling the filaments obtained by means of a flow of air 8 and in drawing them in a slot 11 and, finally, in depositing the said drawn filaments on the said collecting belt 4 or continuous strip, without preferential orientation and homogeneously.

Furthermore, a suction device 11' is placed under the collecting belt 4, creating a suction effect at the latter, intended to flatten the filaments against it.

Such a process is more generally known under the name of S-Tex for the production of synthetic nonwovens.

In accordance with a characteristic of the invention the temperature of the extruder 2 is advantageously between 245° C. and 295° C. for this second embodiment.

According to a third alternative embodiment of the invention, not shown in the attached drawings, the process in accordance with the invention may also consist in pushing the melt through a die which has a multitude of holes in line and in then drawing the filaments obtained by means of hot air currents moving around the die and in the direction of the collecting belt and, finally, in projecting the said filaments, without preferential orientation and homogenously, onto the said moving collecting belt.

The temperature of the melt originating from the extruder 2 is advantageously set, on the one hand, by a first heating circuit 12 comprising a first heat transfer fluid, when it is being conveyed from the extruder 2 towards the die 3, 3' and, on the other hand, by a second heating circuit 13 comprising a second heat transfer fluid, which differ from the said first devices and fluids, at the die 3, 3', the said melt thus being capable of being heated to different temperatures as a function of the operations to be undergone.

The first heat transfer fluid, for example of the type known by the name of marlo, will be capable of imparting to the melt a temperature sufficient for its transfer from the extruder 2 towards the die 3, 3', while the second heat transfer fluid, for example the type known under the name of dyphil, will heat the said melt to a higher temperature, allowing it to be spun.

With a view to guaranteeing a uniform quality of the web or of the sheet of nonwoven, it is preferable to feed the die 3, 3' by means of positive-displacement pumps 14 connected to the exit of the extruder 2 (FIGS. 2 and 3) or by means of a booster pump 15 (FIG. 1).

In accordance with a characteristic of the invention, the draw ratio of the filaments is advantageously between 100% and 1000% and the web or the sheet of nonwoven obtained may be treated by impregnation or by spraying with surface-active agents.

By way of practical example of implementation of the process in accordance with the invention, an indication is given below of the values of the various essential operating parameters involved in the process for manufacture of the nonwoven according to the invention which are obtained according to the first alternative embodiment (Table 1) or according to the second alternative embodiment, which are mentioned above (Table 2).

TABLE 1

| Nature of the parameters | Place/item in question | Units | Values test |
|---|---|---|---|
| Speed | extruder (screw) | rev/min | 15 to 90 |
| | pos. disp. pumps | rev/min | 4 to 20 |
| | belt | m/min | >6 |

TABLE 1-continued

| Nature of the parameters | Place/item in question | Units | Values test |
|---|---|---|---|
| Throughput | extruder | kg/h | 25 to 140 |
| Temperature | zone 1 | °C. | 190 ± 5 |
| | zone 2 | °C. | 200 ± 5 |
| | zone 3 | °C. | 200 ± 5 |
| | zone 4 | °C. | 200 ± 5 |
| | zone 5 | °C. | 200 ± 5 |
| | 1st heat circ. | °C. | 210 ± 5 |
| | die | °C. | 195 ± 5 |
| | 2nd heat circ. | °C. | 210 ± 5 |
| Pressure | extruder | bars | 14 |
| | booster | bars | 84 |
| | pos. disp. pumps | bars | 50 |
| | die | bars | 60 |
| | 2nd heat circ. | bars | 3 |
| Air temperature | cooling | °C. | 15 ± 5 |
| Air speed | | m/s | 0.5 to 2.5 |
| Suction | | mm of HW | 75 |
| Filament speed | drawing | m/s | 10 to 90 |
| Draw ratio | | % | 200 to 900 |
| Sprockets T° °C. | | | 105 ± 15 |
| smoother T° | calender | °C. | 105 ± 15 |
| Pressure | | daN/cm | 50 ± 10 |
| Gumming speed | impregnation | m/min | 3 |
| Active prod. content | treatment | % | 12 |
| Type | | / | Silvet |

TABLE 2

| Nature of the parameters | Place/item in question | Units | Values |
|---|---|---|---|
| Speed | extruder (screw) | rev/min | 15 to 80 |
| | pos. disp. pumps | rev/min | 4 to 22 |
| | belt | m/min | 5 to 200 |
| Throughput | | kg/h | <140 |
| Temperature | zone 1 | °C. | 250 ± 5 |
| | zone 2 | °C. | 290 ± 5 |
| | zone 3 | °C. | 290 ± 5 |
| | zone 4 | °C. | 290 ± 5 |
| | zone 5 | °C. | 290 ± 5 |
| | 1st heat circ. | °C. | 200 ± 5 |
| | die | °C. | 240 ± 5 |
| | 2nd heat circ. | °C. | 245 ± 5 |
| Pressure | extruder | bars | 37 |
| | booster | bars | 46 |
| | pos. disp. pumps | bars | 24 |
| | die | bars | 18 |
| Suction | | mm of HW | 50 |
| Filament speed | drawing | m/s | 2 << 30 |
| Draw ratio | | % | 150 << 900 |
| Sprockets T° | | °C. | 132 ± 15 |
| Smoother T° | calender | °C. | 132 ± 15 |
| Pressure | | daN/cm | 50 |
| Gumming speed | impregnation | m/min | 3 |
| Active prod. content | treatment | % | 12 |
| Type | | / | Silvet |

The median values of the operating parameters shown in Table 1 make it possible to obtain nonwovens which can be employed for applications in agriculture and in hygiene and which exhibit the characteristics mentioned in Tables 3 and 4 below, this being as a function of the polymer employed for their production, A (Table 3) and B (Table 4), respectively.

TABLE 3

| Weight | | g/m² | 20 | 25 |
|---|---|---|---|---|
| Strength | md | N/5 cm | 22 | 26.5 |
| | td | N/5 cm | 8.5 | 10 |
| Elongation | md | % | 2.5 | 2.5 |
| | td | % | 2.5 | 2.4 |
| Air permeability | (10 Pa) | 1/m²/s | 1500 | 1300 |
| Absorption | time | s | <3 | <3 |
| Filament | denier | dtex | 2.2 | 2.5 |
| MFR | (I2 190° C.) | / | / | 400 |

TABLE 4

| Weight | | g/m² | 50 | 100 |
|---|---|---|---|---|
| Strength | md | N/5 cm | 60.2 | 110.5 |
| | td | N/5 cm | 23.5 | 40.5 |
| Elongation | md | % | 3.1 | 3.5 |
| | td | % | 2.9 | 3.5 |
| Air permeability | (10 Pa) | 1/m²/5 | 650 | 300 |
| Absorption | time | s | <3 | <3 |
| Filament | denier | dtex | 2.2 | 2.2 |
| MFR | (I2 190° C.) | / | 400 | 400 |

Tables 3 and 4 above show, in addition to the conventional characteristics such as weight, tensile strength and elongation (along the machine direction: md and perpendicularly to the latter: td) and denier of the filaments of the nonwoven obtained, some special characteristics of the said nonwoven, such as air permeability (under a partial vacuum of 10 pascals), absorption coefficient (time for 5 cm³ of urine to pass through the web or the sheet of nonwoven—Edam standard 150-1-90) and also melt index (MFR-ISO Standard 1133 at T=190° C.).

The four nonwovens described in Tables 3 and 4 were treated, as shown in the preceding Table 1, by means of a surfactant known by the name of Silvet (trademark) by the Union Carbide Company.

In order to test the degree and the rate of degradability of the nonwovens in accordance with the invention, samples exhibiting the characteristics mentioned in Table 3, intended more particularly for articles of hygiene, were mixed with vegetable food waste and converted into compost and humus in a reactor of the composter type.

For eight days, the temperature in the reactor was set at 55° C., the moisture content of the mixture maintained at 50% and air supply was ensured.

After this period it was found that the nonwoven had degraded considerably and that only a few filaments were still visible.

The compost was then extracted from the reactor and spread in the open air for 10 weeks. At the end of this second period no more filaments could be seen and the decomposition of the nonwoven was complete.

Similarly, nonwovens exhibiting the characteristics mentioned in Table 4 were employed as mulching webs in market-gardening and horticultural crops for combating weeds, as a replacement for plant-protection products.

The following properties were found by testing these nonwovens on young conifer and lettuce plants:

- weed control without the use of herbicides (inspection of the number of adventitious plants and of their size),
- activation of the microorganisms in the soil, the nonwovens constituting an excellent cultivating substrate,
- limitation of the evaporation (moisture content higher than 80% at 22° C.).

The degradability of the nonwoven is ensured by watering, by rain and by the activity of the microorganisms at the same time.

Sampling performed on the webs on test made it possible to ascertain that the mechanical properties were dropping by 10% in 2 months.

Naturally, the invention is not restricted to the embodiments described and shown in the attached drawings. Modifications remain possible, especially from the viewpoint of the constitution of the various components, or by substitution of technical equivalents, without departing thereby from the scope of protection of the invention.

We claim:

1. A nonwoven web or nonwoven sheet consisting essentially of a polymer of L- and D-lactic acids and which polymer has a weight average molecular weight of between 100,000 g/mol and 200,000 g/mol, a polydispersity value of between about 1 and about 3, and a glass transition temperature of between about 45° C. and 55° C.

2. The web or sheet of claim 1 in which the polymer has a melting temperature of between about 165° C. and 180° C.

3. The web or sheet of claim 2 in which the polymer is in form of filaments which are of denier between 0.5 and 10 dtex.

4. The web or sheet of claim 3 in which the filaments have a draw ratio between 100% and 1000%.

5. The web or sheet of claim 4 which has a machine direction elongation in the range of 2.5–3.5%.

6. The web or sheet of claim 5 which has a transverse direction elongation in the range of 2.5–3.5.

7. The web or sheet of claim 6 which has a machine direction strength in the range of about 22–110.5 N per 5 cm.

8. The web or sheet of claim 7 which has a transverse direction strength in the range of about 8.5–40.5 N per 5 cm.

9. The web or sheet of claim 8 which has an air permeability at 10 Pa in the range of 300–1500 $L/m^2/s$.

10. The web or sheet of claim 9 which has a weight in the range of about 20–100 $g/m^2$.

11. The web or sheet of claim 1 which is spunbond or melt blown.

12. The web or sheet of claim 11 in which the polymer has a melting range of between about 165° C. and 180° C.

13. The web or sheet of claim 12 which has an air permeability at 10 Pa in the range of 300–1500 $L/m^2/s$.

14. The web or sheet of claim 1 in which the polymer is in form of filaments treated with a surface active agent, thereby making the web or sheet hydrophilic or hydrophobic.

15. The web or sheet of claim 14 in which the surface active agent is a polyether silicone copolymer.

16. The web or sheet of claim 15 which is spunbond.

17. The web or sheet of claim 15 which is melt blown.

* * * * *